United States Patent [19]

Sturm et al.

[11] 3,996,568

[45] Dec. 7, 1976

[54] ARRANGEMENT FOR PROCESSING INFORMATION ON GOODS IN PROCESS IN AN AUTOMATIC ELECTROPLATING PLANT

[75] Inventors: Karl-Heinz Sturm, Berlin; Rudolf Kreisel; Egon Hubel, both of Nurnberg, all of Germany

[73] Assignee: Schering Aktiengesellschaft, Berlin and Bergkamen, Germany

[22] Filed: Mar. 18, 1975

[21] Appl. No.: 559,418

Related U.S. Application Data

[63] Continuation-in-part of Ser. No. 360,035, May 14, 1973, abandoned.

[52] U.S. Cl. ..... 340/172.5; 204/202; 214/11 C

[51] Int. Cl.[2] ..... C25D 21/12; C25D 17/28; B65G 47/22; G06F 15/46

[58] Field of Search ..... 340/172 S; 235/151, 235/151.1, 151.12; 214/17 CA, 11 R, 11 C; 204/198, 199, 200, 202, 203; 118/7, 8

[56] References Cited

UNITED STATES PATENTS

| | | | |
|---|---|---|---|
| 3,576,540 | 4/1971 | Fair | 340/172.5 |
| 3,646,521 | 2/1972 | Porter | 340/172.5 |
| 3,696,946 | 10/1972 | Hunter | 214/11 R |
| 3,725,867 | 4/1973 | Jordan | 340/172.5 |
| 3,739,742 | 6/1973 | Racz | 118/8 |
| 3,761,378 | 9/1973 | Strum | 204/202 |
| 3,764,990 | 10/1973 | Brian | 340/172.5 |

*Primary Examiner*—Gareth D. Shaw
*Assistant Examiner*—James D. Thomas
*Attorney, Agent, or Firm*—Joseph F. Padlon

[57] ABSTRACT

An arrangement for processing information pertaining to articles to be treated in automatic electroplating plants with work stations, article transport means, and article storage or holding locations. To each transport device and each location in the electroplating plant, there is assigned at least one storage unit which is logically connected with the central control unit and with the transport device circuit elements triggering the transport operation. It is also connected with the article storage or holding locations. The prevailing information pertaining to the articles treated is always inserted in that storage which is assigned to the transport device or to the location where the article is positioned at that time.

6 Claims, 4 Drawing Figures

ARRANGEMENT FOR PROCESSING INFORMATION ON GOODS IN PROCESS IN AN AUTOMATIC ELECTROPLATING PLANT

BACKGROUND OF THE INVENTION

The present application is a continuation-in-part of the copending parent application Ser. No. 360,035, filed May 14, 1973 now abandoned.

The present invention relates to a circuit arrangement for processing or retransmitting information on goods in process, in an automatic electroplating plant.

A method known in the art for retransmitting information on goods is, for example, a method in which the informations are taken along the the goods carrier. This is accomplished by providing the goods carrier with suitable identification devices, as, for example, circuit elements in an electric or mechanical manner which are interrogated or sampled by means of suitable interrogation or sampling equipment at the location where these informations are required.

A disadvantage of this known method is the following: The identification devices to be attached to each goods carrier move along with the carrier through the entire electroplating plant and are subjected to severe mechanical and chemical operating conditions. Another disadvantage is that at each goods storage or holding location and at each bath where the goods information is required, an interrogating device must be installed which requires considerable expenditure for installation and cabling. In addition, a very accurate adjustment of all identification devices on the goods carrier is required at all interrogating devices or stations.

Because of the large number of goods carriers on the one hand, and the larger number of baths on the other hand, a large number of interconnections between the identification devices and interrogating devices is required. As a result, difficulties frequently occur during the adjustment. Because of the possibility that goods carriers can be removed from the plant installation, they become subjected to mechanical handling and operating conditions. Therefore, perfect adjustment is no longer quaranteed and errors occur frequently during the interrogation of the identification devices.

Another disadvantage is that the passage of the goods carriers cannot be simulated since the retransmission of information on the goods is tied to the carrier.

In practical application, however, it has been found that it is frequently advantageous, during the entering or exiting phase, or when switching from one program to another, not to actually undertake the passage of one or several goods carriers. Rather, it has been found particularly advantageous to undertake simulation when individual goods carriers, must be removed from circulation for servicing or repair.

Accordingly, it is an object of the present invention to avoid the above-mentioned disadvantages and to retransmit or process information on goods in process without equipping all goods carriers with identification devices and without providing all baths with interrogating or sampling devices and without all goods carriers in circulation.

Another object of the present invention is to provide an arrangement of the foregoing character which is simple in design and may be economically operated.

A further object of the present invention is to provide an arrangement, as described, in which the components are readily accessible for servicing and maintenance.

SUMMARY OF THE INVENTION

The objects of the present invention are achieved by an arrangement in which each transport unit and each location in the electroplating plant is assigned one storage (WSP) which is logically bound up with the central control unit and with the circuit elements of the transport unit and the storage locations to be controlled for starting the transport operations. The prevailing information on the goods in process must always be inserted in that storage unit which is assigned to the transport unit or the location where the goods in question are at that time.

The meaning of locations herein is the storage locations and the electroplating baths.

In a preferred form of construction of the circuit arrangement, the storages (WSP) assigned to the storage locations and to the transport units have several inputs. The storages (WSP) use relays, and, to advantage, locking relays. The storages (WSP) are made up of electronic circuit elements. The storages (WSP) are part of a digital computer and the location switches (ST), preferably in separate planes, are assigned to the transport unit.

The transport operations consist of the forward, rearward, raising and lowering operations of the transport equipment, e.g., the transport carriages (TW). These are equipped with two drives, a drive for forward and rearward travel and a drive for raising (H) and lowering (S) of the goods carriers which in this manner can be stored in the holding locations, for example the galvanic baths.

Assigned to the transport device, as for example, to the transport carriages, are location switches (ST). This is done in such a way that each transport carriage can actuate only its assigned location switch when traveling past that switch.

Each location is provided with a storage (WSP1 . . . WSPN) and each transport device, e.g., the transport carriage is provided with a storage (WSPA, WSPB, WSPC, . . . ) for receiving information on the goods or articles to be processed. They are digital storages. The capacity of each storage is the same. It is at least 1 bit. If large storage capacities are required, the use of a digital computer is particularly economical.

The commands for raising (H) and lowering (S) are used in a suitable fashion in order to make possible the storing or the transmission of information.

The mode of operation of this arrangement is explained on an example provided with locking storage relays, as follows:

At loading location (ST 1A), an article is placed on a goods carrier and, at the same time, the information about the article is placed through an input keyboard (input sampler) into the storage (WSP 1) assigned to the loading location. To pick up the article, the transport carriage A (TWA) enters location (ST 1A), with its hoisting unit lowered, stops and lifts the article beam, and then leaves the location with the article, with the hoisting unit raised.

After the hoisting movement has been initiated, the information about the article deposited in storage (WSP 1) is placed in the storage (WSPA) assigned to the transport carriage. After the hoisting movement is finished, the storage (WSP 1) is cleared. Now the transport carriage travels, for example to location 3 where it drops and continues to travel in that position. As a result, the article beam is deposited in location 3.

wing to the lowering motion of the transport carriage, ie article information from storage (WSPA) of the ansport carriage is placed in the storage (WSP 3) ssigned to location 3. After the lowering movement is ompleted, the storage (WSPA) is cleared. In this man- er the article information is passed on throughout the ntire installation.

The novel features which are considered as charac- eristic for the invention are set forth in particular in ie appended claims. The invention itself, however, oth as to its construction and its method of operation, ogether with additional objects and advantages iereof, will be best understood from the following escription of specific embodiments when read in con- ection with the accompanying drawings.

DESCRIPTION OF THE PREFERRED EMBODIMENTS

Figure 1:
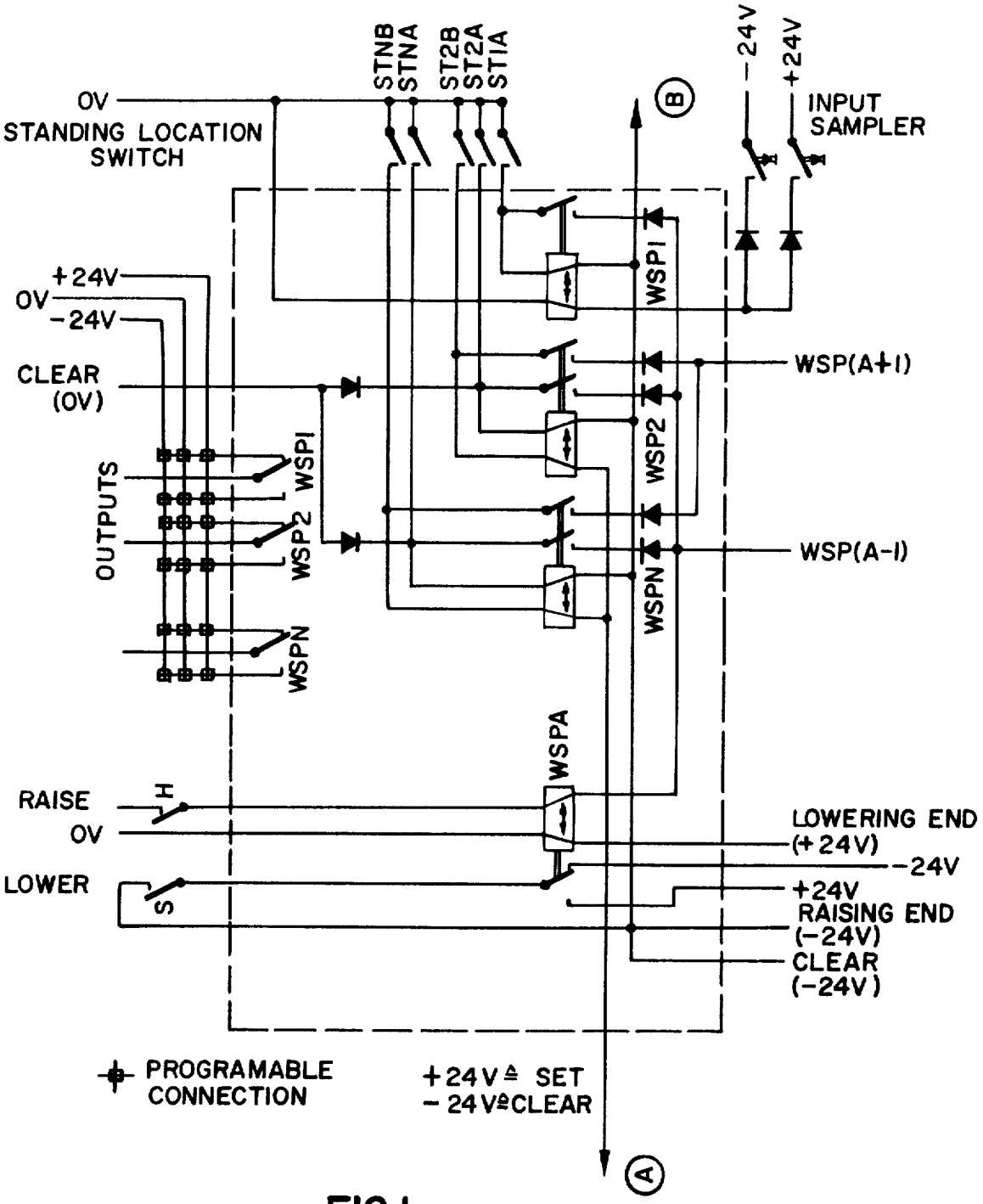
FIG. 1 shows a section of the arrangement of the elay unit for a 1-bit article information for a transport arriage travel range with three locations.
Figure 2:
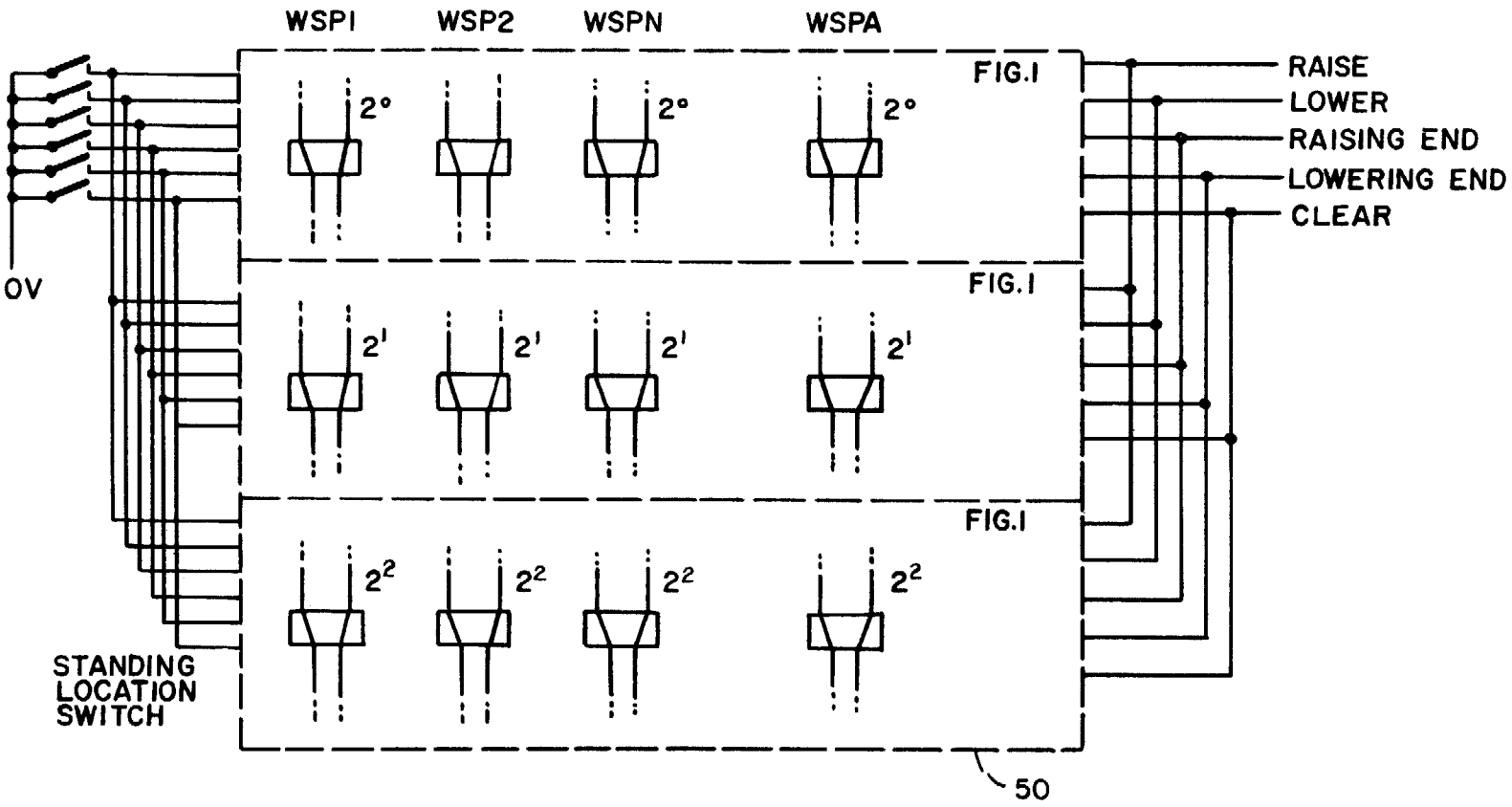
FIG. 2 shows a schematic of the arrangement accord- ng to FIG. 1, when 3-fold as 3-bit article information, he input and clear connections A, B, C and D from one ransport carriage to the adjoining transport carriage eing not shown.

In referring to the drawing, the constructions shown therein uses relays, although semi-conductors may be applied with substantially equal advantages.

Storage WSP 1 is assigned to the loading location of the automatic electroplating plant with the location designation St 1A. The location St 1A is approached only by the transport carriage TWA. By means of the input keyboard "Input Sampler" operating personnal of the automatic electroplating plant sets or clears storage WSP 1 in accordance with the article informa- tion. The storage WSP is a bistable and polarized relay. Therefore, when actuating the manual key to the +24 V supply voltage, the storage WSP 1 is set and with the manual key to the −24 V supply voltage it is cleared. Each of these relays has two separate windings *a* and *b*, each of which exerts the same effect on the relay. Each article information bit requires a keyboard as shown in FIG. 1.

The transfer of the article information placed manu- ally into storage WSP 1 to storage WSPA (assigned to the transport carriage TWA) and the retransfer to the subsequent storages WSP, is accomplished by means of control signals. These are derived from the transport carriage control in accordance with the movements of the transport carriage, as follows.

Figures 1, 4:
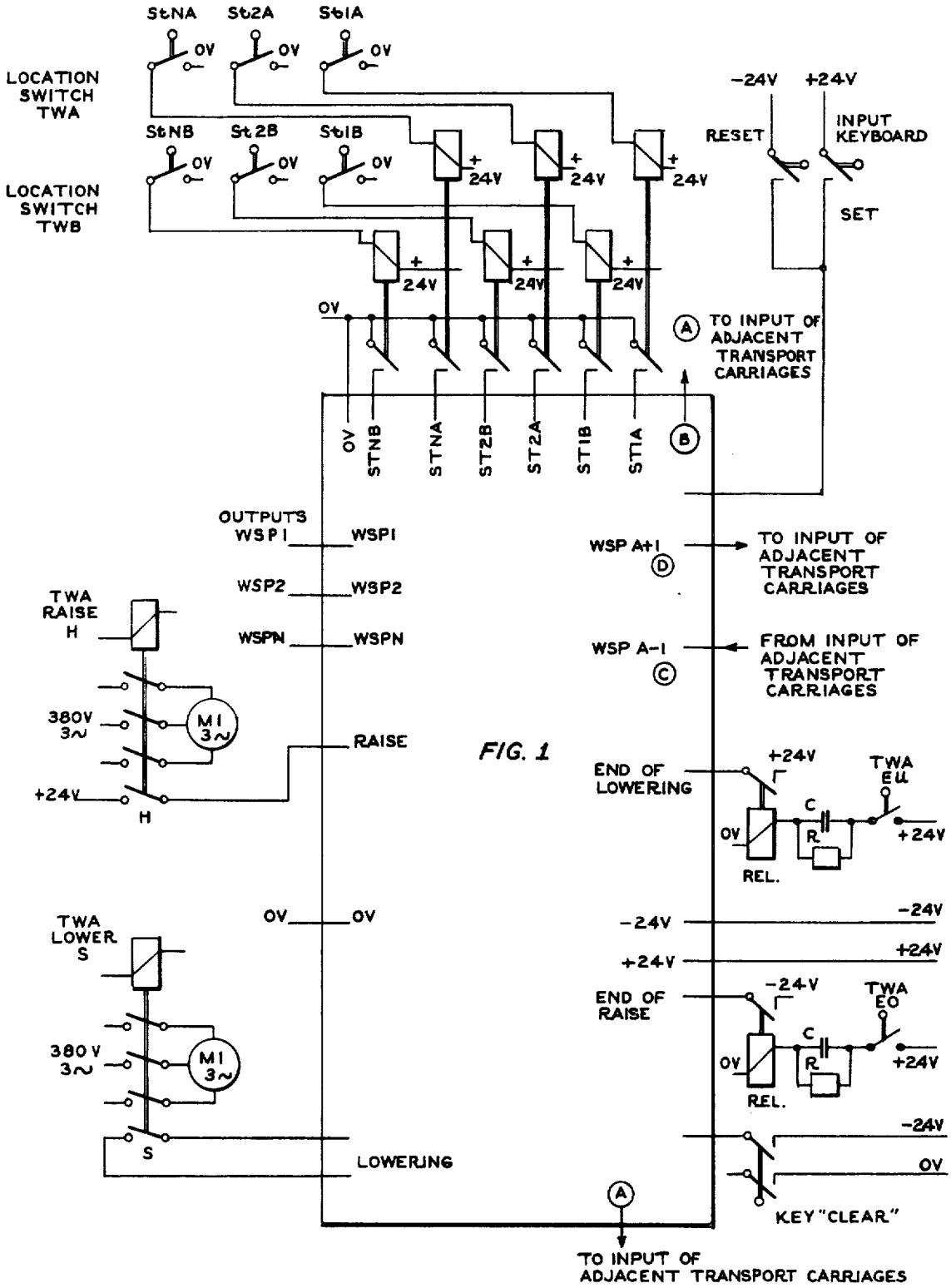
FIG. 4 shows the formation of the control signals at a rasnport carriage TWA which are necessary for the article information storage unit. M1 denotes the motor for raising and lowering. The limit switch EO turns off the hoist motor in the upper hoist position and EU turns it off in the lower hoist position. The location switches St 1 through St N are actuated by the trans- port carriage by means of a mechanical cam in the location mid position.

With the hoisting unit lowered, the limit switch EU (FIG. 4) is actuated. With the hoisting unit raised, the limit switch EO is actuated. During the raising (H) is actuated and during lowering S is actuated. The relays Rel. in connection with R and C in FIG. 4 represent a pulsing device, corresponding to a monostable flip- flop. In order to take over the article information, transport carriage TWA enters the loading location with location designation St 1A with its hoisting unit lowered. As a result, location switch St 1 is actuated. Contact St 1A closes. As a result, circuit *a* of storage WSP 1 and circuit *a* of storage WSPA are connected to 0 Volt via the contact of relay WSP 1 if this relay was set previously.

During the raising of the article or goods carrier, contact H closes and winding a of storage WSPA is connected to +24 V. If WSP 1 had been set, WSPA also had been set. Upon termination of the hoisting move- ment, limit switch EO (FIG. 4) closes. The associated relay Rel triggers a pulse of −24 Volts via the input "End of Raise" which in turn clears the storage WSP 1 via winding *a*.

Transport carriage TWA, with the article carrier in the raised position, leaves location St 1. Contact St 1A opens.

Now the article carrier is to be transported, e.g., to location St 2. The transport carriage TWA travels to this location. The location switch St 2A closes.

During the lowering of the article carrier, contact S closes and winding *a* of storage WSP 2 receives power. The polarity of this voltage depends on whether storage WSPA is set or cleared. In case of information storage set the +24 Volt voltage is connected to winding *a* of storage WSP 2 and in case WSPA storage cleared the −24 Volt voltage is switched through. The +24 Volt voltage sets the storage WSP 2, the −24 Volt voltage clears this storage.

Upon termination of the lowering movement, limit switch EU (FIG. 4) closes. As a result, the associated relay Rel. releases a pulse of +24 Volt via the input end of lowering which in turn clears the storage WSPA via winding *b*.

In this manner, the article information has been moved from storage WSP 1 by means of storage WSPA to storage WSP 2, corresponding to the actual move- ment of the article in the electroplating plant.

The transport carriage, with the hoisting unit low- ered, travels to another location to receive an article carrier. The process repeats itself as described.

Figure 3:
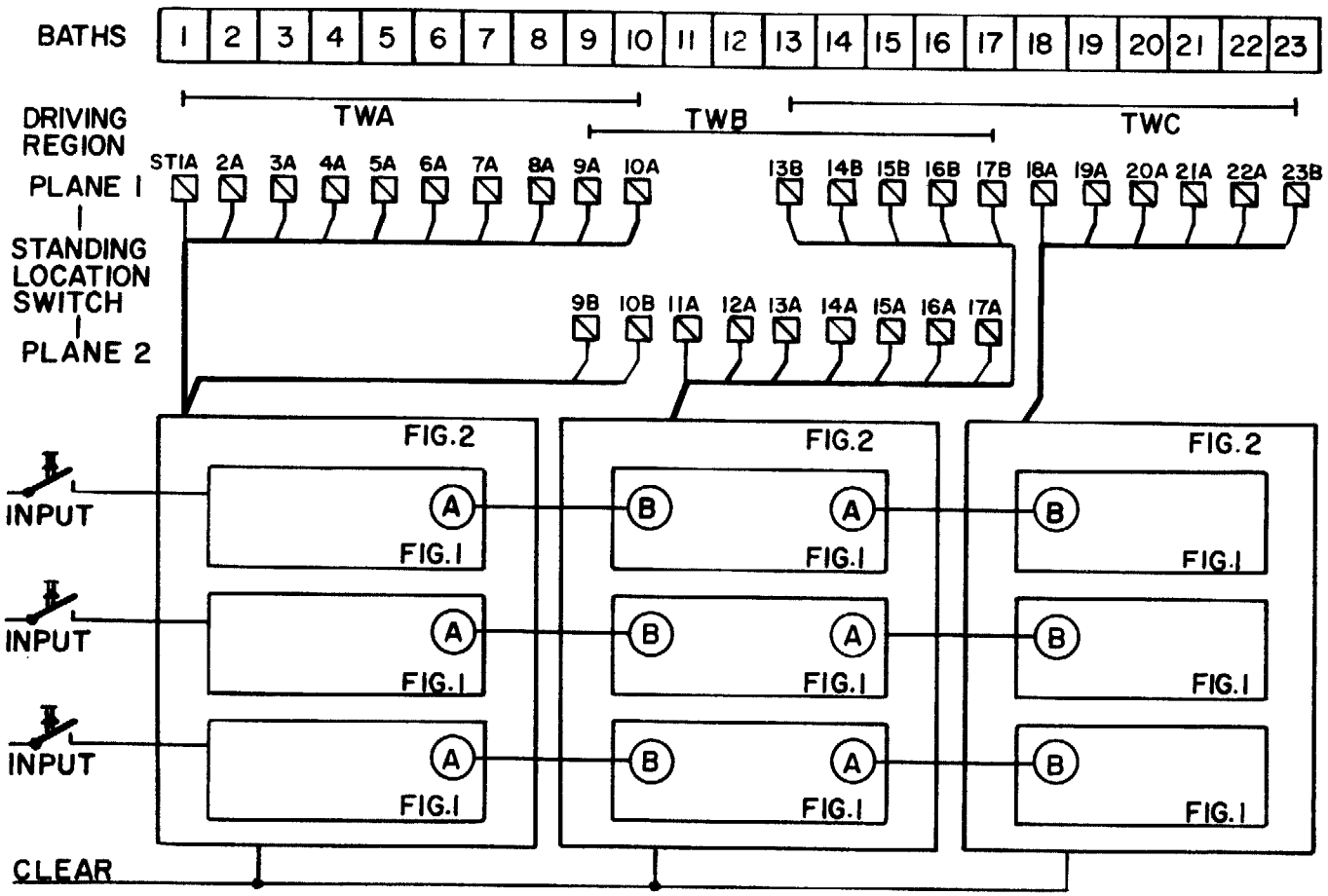
FIG. 3 shows a schematic of a 3-bit article informa- ion arrangement for three transport carriage travel anges, with input and clear connections from one ransport carriage to the adjoining carriage, the inputs or the controlling logic circuit being not shown.

Most electroplating plants have several transport carriages. Every transport carriage has a certain travel range. Ordinarily, the travel ranges of the individual transport carriages overlap, i.e., transport carriage A, like transport carriage B touches a certain number of identical locations. In FIG. 3 they are, for example, the locations 9 and 10. Therefore, it is necessary that the storage WSP assigned to the locations in the overlap- ping regions (ranges) can connect to both transport carriage storages WSPA and WSPB. This is accom- plished as follows. The transport carriage TWA actu- ates the location switches St 1A through St 1N and the overlapping TWB actuates the location switches St 1B . . . ST NB in the overlap area of the TWA. This means, the storages WSP have two inputs.

The work cycle will be explained by an example:

Location N with its associated storage WSPN belongs to the travel range of the TWA and in the overlap area also to TWB. FIGS. 1 and 4 show the arrangements on the TWA. Similar arrangements are made for TWB and TWC, as shown in the schematic of FIG. 3.

Assume that WSPN is reset by WSPA via TWA. The transport carriage TWB picks up the article from location StN, i.e., it must also take on the information of storage WSPN. This is done as follows. TWB at location St N actuates location switch ST NB in the relay section of the TWA. The winding *b* of storage WSPN is connected to 0 Volt. In the TWB, H is actuated during raising. Hence, the circuit for winding *a* of storage WSPB in the TWB closes via ST NB, contact of storage WSPN, diode and output WSP (A+1) (all in the relay section of the TWA) to the relay section of the TWB via input WSP (A-1), the winding "a" of storage WSPB and H to +24 Volt. Storage WSPB is set, or not set if the storage WSPN in the relay section of the TWA has not been set.

Vice versa, it must also be possible to transfer information from storage WSPB of the TWB to a storage WSP assigned to the TWA. As an example, take WSP 2 and assume WSPB has been set.

While lowering the TWB at location St 2, S in the relay section of the TWB closes and the contact ST 2B in the relay section of the TWA is closed, since TWB is at location St 2. The current for the winding *b* of storage WSP 2 is closed, from +24 Volt via the contact WSPA, S and output (all in the relay section of the TWB) to the relay section of the TWA via input, winding *b* of the WSP 2 and St 2. The storage WSP 2 has been set in accordance with the information of storage WSP B of transport carriage B. When WSP B is not set, in this example case WSP 2 is cleared, since −24 Volt are switched through.

When starting to operate the electroplating plant, it is advantageous if the storages WSP can be cleared manually. For this purpose, clear inputs are provided (FIGS. 1 and 4). Via these inputs, −24 Volt are switched to the storages WSP 2 through WSP N. This affects the clearing.

The outputs of all storages including WSPA, WSPB, etc. are available for control tasks of the electroplating plant control. In the form of construction according to FIG. 1, the outputs can be programmed in such a way that in the set state 0 Volt, +24 Volt or −24 Volt or in the non-set state 0 Volt, +24 Volt or −24 Volt are available.

The arrangement of the subject invention offers special advantages: all identification devices on the goods carriers carrying the goods or articles become superfluous and so do all interrogation devices at the locations and the goods article transport equipment. They are free from sensitive switching devices and associated installations.

No adjustment whatsoever is necessary. For control purposes, interrogation or sampling may be done at any time and at any place, both in automatic and manual operation.

The information on the goods can also be stored in a static manner so that such information is retained even when the control voltage should fail.

A further advantage is, that the arrangement of the present invention can also be installed as a closed unit in already existing plants, without special expenditure.

The run-through or passage of goods with associated information can be simulated without having goods carriers enter the plant.

The storage means used in the present invention may also be in the form of storage elements within a digital computer 50, for example. Without further analysis, the foregoing will so fully reveal the gist of the present invention that others can, by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for processing information pertaining to articles to be treated in an automatic electroplating plant comprising, in combination, work station means; article transport means, and article holding location means; storage means connected to said article transport means, said transport means having article transport initiating elements connected to said storage means for initiating the transport of an article; means for connecting said storage means to said article holding location means, said storage means having storage units connected to said transport means and to said article holding location means, and means for inserting into predetermined storage units information pertaining to articles treated; said information in said storage means directing the transport of articles to be treated by said transport means between said work station means and said holding location means, said storage means comprising storage elements within a digital computer.

2. The arrangement as defined in claim 1 wherein said storage units connected to said article holding location means have a plurality of inputs.

3. The arrangement as defined in claim 1 wherein said storage means comprises relay means.

4. The arrangement as defined in claim 3 wherein said relay means comprises locking relay means.

5. The arrangement as defined in claim 1 wherein said storage means comprises electronic storage elements.

6. The arrangement as defined in claim 1 including switching means connected to said transport means, said switching means comprising a plurality of switches in separate planes.

* * * * *